United States Patent [19]

Deschenes

[11] 4,096,782

[45] Jun. 27, 1978

[54] BARRIER FOR WHEELED VEHICLES

[75] Inventor: Pierre J. Deschenes, Shrivenham, Nr. Swindon, England

[73] Assignee: Her Majesty the Queen in right of Canada, as represented by the Minister of National Defence, Ottawa, Canada

[21] Appl. No.: 689,173

[22] Filed: May 28, 1976

[30] Foreign Application Priority Data

May 29, 1975 Canada ..... 228002

[51] Int. Cl.[2] ..... F41H 11/08

[52] U.S. Cl. ..... 89/1 A

[58] Field of Search ..... 89/1 A; 102/48; 172/21, 172/599, 601, 555

[56] References Cited

U.S. PATENT DOCUMENTS

| | | | |
|---|---|---|---|
| Re. 22,924 | 10/1947 | Mader | 172/599 |
| 1,807,182 | 5/1931 | Stoner | 172/555 X |
| 2,024,623 | 12/1935 | Burg | 172/555 |
| 2,325,260 | 7/1943 | May | 89/1 A |
| 2,527,234 | 10/1950 | Taylor | 172/599 X |
| 3,062,300 | 11/1962 | Bullard | 172/21 |

FOREIGN PATENT DOCUMENTS

| | | | |
|---|---|---|---|
| 593,355 | 2/1934 | Germany | 89/1 A |
| 868,293 | 5/1961 | United Kingdom | 172/21 |
| 883,824 | 12/1961 | United Kingdom | 172/21 |

*Primary Examiner*—David H. Brown

*Attorney, Agent, or Firm*—Stevens, Davis, Miller & Mosher

[57] ABSTRACT

Previous devices for inhibiting the passage of pneumatically tired wheeled vehicles have been too heavy or bulky for quick deployment and easy transport. A portable easily assembled barrier is disclosed which has a number of planar cutters which have a base to engage a roadway and to orient the cutting surfaces. These cutters are spaced along an elongated rod by a number of distance pieces and the distance piece at each end can be used to connect one rod to another so that the assembly can span a roadway.

5 Claims, 4 Drawing Figures

BARRIER FOR WHEELED VEHICLES

This invention relates to a barrier for vehicles having pneumatic tires.

Previous devices have included steel plates with knives or spikes welded to the surface or caltrops mounted on a chain, which can be stretched across a roadway. Such devices have been too heavy or bulky or they have not been effective enough to damage tires so that a vehicle can no longer be driven. They are usually difficult to transport.

This invention includes a barrier adapted to check the passage of pneumatically tired vehicles which comprises an elongated rod, a plurality of substantially planar cutters each having an aperture therethrough to enable the cutter to be mounted on the rod, each cutter having a base to orient the cutting edges relative to a surface for passage of vehicles and spacer means for spacing said cutters along said elongated rod.

In a more limited aspect, the invention also comprises means for connecting one elongated rod to another; in another more limited aspect each substantially planar cutter is formed of two similar plates each plate having a profile formed as of a square central portion, and two triangles having two opposite sides of the square as their bases, and wherein the two plates are secured together with their length dimensions at right angles to one another.

The invention will best be understood after referring to the drawings which illustrate by way of example, a portable, easily assembled road barrier, and the manner of its construction.

Figure 1:
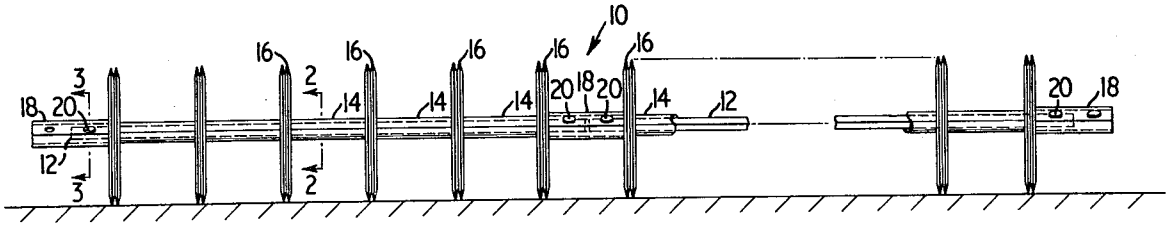
FIG. 1 is an elevation of an assembled barrier on a roadway.

In FIG. 1 the assembled barrier 10 comprises six elongated square section rods 12 which are not normally seen; however, cylindrical spacers, or distance pieces 14 have been cut away to show the construction of the assembly. These spacers act to distance the cutters 16 from one another along each rod 12. The stack of cutters 16 and distance pieces 14 are retained on the rod by hollow square section securing spacers 18, which are retained by clevis pins 20 with their associated split pins 22. These securing spacers 18 also serve as connectors so that one rod, while a complete subassembly, and useful by itself, can be joined to others to extend across the width of a roadway. To give typical dimensions, which are in no way a limitation, the rods 12 are 27 inches long and of $\frac{5}{8}$ inch square section steel bar with a protective enamel finish; the spacers are of $1\frac{1}{8}$ inch outside diameter, 0.935 inch inside diameter and 4 inches long, with a similar finish; the retainers are also 4 inches long, similarly finished but of 1 inch outside square mechanical steel tube with a 0.120 inch wall thickness.

Figure 2:
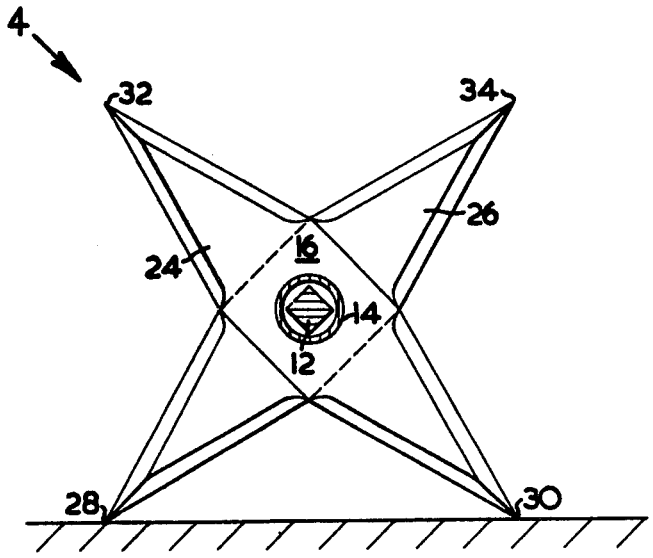
FIG. 2 is a sectional view in the direction of arrows 2—2 in FIG. 1.
Figure 3:
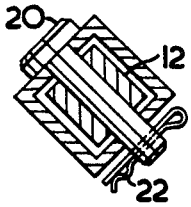
FIG. 3 is a sectional view on arrows 3—3 in FIG. 1.
Figure 4:
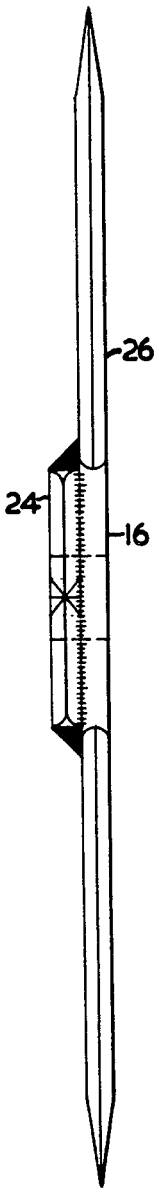
FIG. 4 is a view showing the construction of the cutters, seen in the direction of arrow 4 on FIG. 2.

The cutters 16, as will be seen by reference to FIGS. 2 and 4 are formed of two similar $\frac{1}{4}$ inch thick steel plates 24, 26; each plate has a central square of $2\frac{1}{4}$ inches side with a triangle of 4 inches height on two opposite sides of the square so that the overall length of each plate is $10\frac{1}{4}$ inches the maximum width being the $2\frac{1}{4}$ inches of the square. The free edges of each triangle are bevelled to give a cutting edge. The central square has a broached square hole to accommodate a rod 12; the two plates are welded together so that their two length dimensions are at right angles to one another, while they will still accommodate the square rod. The welded cutter assembly is given the enamel finish as for the other components.

Thus, it will be understood that when these components are assembled together, the cutters are spaced at a pitch of $4\frac{1}{2}$ inches along the rod, that is across the roadway, which is comparable to the width of a narrow tire. Two points of each cutter 28, 30 form a base so that the assembly is supported by the roadway at a number of points, while the remaining two points 32, 34 are directed at an angle suitable to engage the tires of vehicles attempting to pass in either direction along the roadway.

It will also be understood that the barrier may be packed in a disassembled condition for easy transportation; a barrier for a roadway 13 ft. wide takes up only a little more space than a $7\frac{1}{4}$ inch square to accommodate the four cutter tips having a total length of 19 inches to accommodate the plate thickness. For convenience, and to accommodate the rods, and ancillary apparatus such as warning flashers for friendly vehicles during deployment, work gloves and the like, the package can be conveniently accommodated in a box whose inside dimensions are $27\frac{1}{2}$ inches $\times$ 17 inches $\times$ 15 inches, with the cutters in two stacks. Such a box, with its contents, can easily be handled by two men.

Additionally, while the cutters 16 have been illustrated as having a "square" center section and triangular pointed sections extending therefrom, it will be understood that the overall cutter configuration could be diamond shaped, elliptical or any other suitable form.

The embodiments of the invention in which an exclusive property or privilege is claimed are defined as follows:

1. A barrier adapted to check passage of pneumatically tired vehicles comprising, in combination, an elongated rod, a plurality of substantially planar cutters each having an aperture therethrough to enable the cutter to be mounted on the rod, each cutter having at least two elongated cutting edges oriented to engage a support surface and to project into the path of vehicle tires, each cutter comprising two similar elongated plates, each plate having a profile defining a central portion and two diametrically opposed cutting tips extending outwardly of the central portion; said two plates being secured together with the length dimensions at right angles to one another and spacer means for spacing said cutters along said rod.

2. A barrier as claimed in claim 1 wherein each substantially planar cutter has four triangular portions projecting from a central portion to form the base and cutting edges.

3. A barrier as claimed in claim 1 wherein the elongated rod is of square section and the holes through the cutters are also square.

4. A barrier as claimed in claim 1 wherein the spacer means comprises distance pieces for mounting between adjacent cutters and two securing means, one for attachment to each end of said elongated rod.

5. A barrier as claimed in claim 4 wherein each securing means also comprise means for connecting one elongated rod to another elongated rod.

* * * * *